United States Patent [19]

DiGiuseppe

[11] 4,008,726

[45] Feb. 22, 1977

[54] TRI-COMB WAVER

[76] Inventor: Domenico M. DiGiuseppe, 400 So. Main Street, Mehanicville, N.Y. 12118

[22] Filed: Oct. 10, 1975

[21] Appl. No.: 621,288

[52] U.S. Cl. ..... 132/9; 132/11 R

[51] Int. Cl.[2] ..... A45D 2/44

[58] Field of Search ..... 132/9, 11, 137–39, 132/141–142, 126, 131

[56] References Cited

UNITED STATES PATENTS

| | | | |
|---|---|---|---|
| 930,678 | 8/1909 | Moore | 132/142 |
| 1,582,244 | 4/1926 | Brenner | 132/131 |
| 1,849,543 | 3/1932 | Gadd | 132/126 |

*Primary Examiner*—G.E. McNeill
*Attorney, Agent, or Firm*—Robert E. Heslin

[57] ABSTRACT

A new type of comb for easily placing a wave of any desire of degree into the hair; the device in one form of the invention consisting of three flat comb members located parallel and spaced apart from each other, each of the combs having a row of teeth along a longitudinal edge thereof, the center comb being made to be slideable toward one end so that hairs extending between the teeth of all three comb members are thus moved laterally into the moving center comb member, thus resulting in the produced wavy hair.

3 Claims, 13 Drawing Figures

TRI-COMB WAVER

This invention relates generally to a comb. More specifically it relates to hair waving devices.

A principal object of the invention is to provide a tri-comb waver with which a person can easily, quickly and accurately produce a wave of any desired degree in his hair.

Another object of the present invention is to provide a tri-comb waver which can be operated by a person's one hand.

Other objects are to provide a tri-comb waver which is simple in design, inexpensive to manufacture, rugged in construction, easy to use and efficient in operation.

These and other objects will be readily evident upon a study of the following specification and accompanying drawings wherein.

Figure 1:
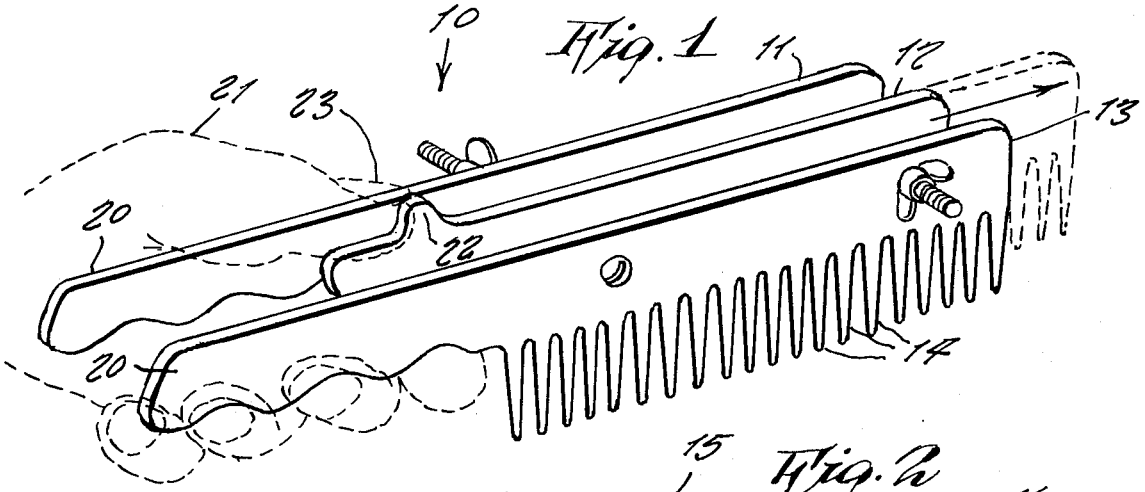
FIG. 1 is a perspective view showing one design of the present invention.
Figure 2:
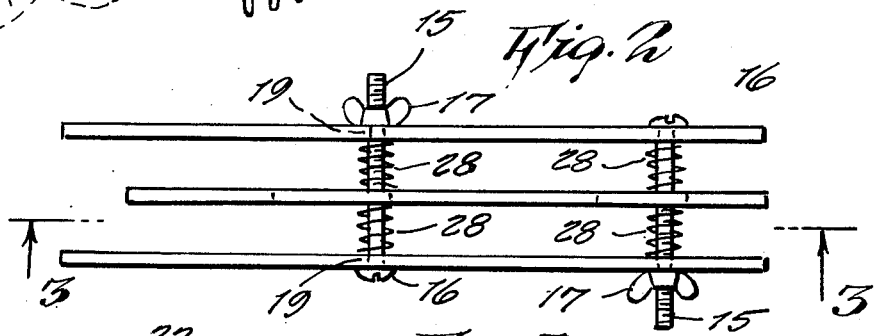
FIG. 2 is a top view thereof.

Referring now to the drawings in detail and more particularly to FIGS. 1 through 6 thereof at this time, the reference numeral 10 represents a tri-comb waver according to the present invention wherein there are three comb members 11, 12 and 13 each of which comprises an elongated flat member having a row of teeth 14 along a longitudinal edge thereof. The three comb members are assembled together in a parallel, spaced apart relation by means of a pair of transverse extending screws 15 each of which has an enlarged head 16 at one end thereof and which upon its opposite threaded end is fitted with a wing nut 17. The center comb member 12 is provided with a pair of elongated slots 18 through which the screws 15 extend, while the outer side comb members 11 and 13 are each provided with circular openings 19 through which the screws extend. Accordingly, it will be therefore evident that the center comb member can be longitudinally slided respective to the other comb members.

Each of the outer side comb members 11 and 13 are provided with an extending handle 20 at its rear end in order to be able to be grasped within the palm of a person's hand 21, as shown in FIG. 1. The center comb member 12 is provided with an upward extending lug 22 upon its upper edge and which is located near a rear end of the comb member so that a person's thumb 23 can push thereagainst while the hand is holding the handles of 20 of the other two comb members.

Figure 4:
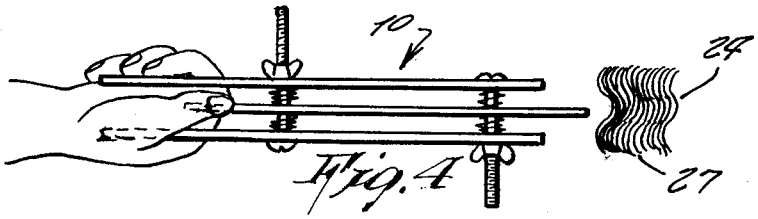
FIGS. 4, 5 and 6 are top views showing the invention set at different widths in order to produce a tight wave, a medium wave or a soft loose wave.
Figure 5:
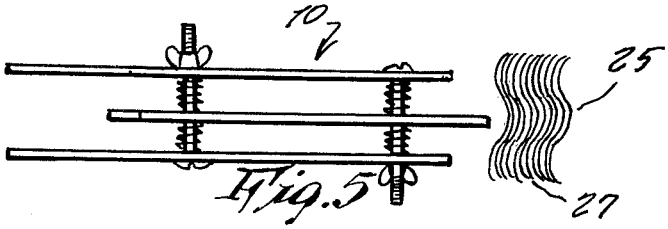
Figure 6:
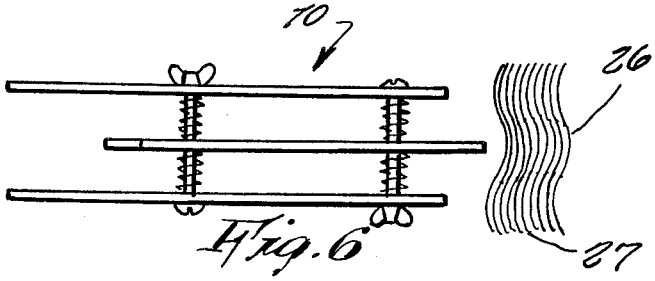

In operative use, as shown in FIGS. 4, 5 and 6, the tri-comb waver 10 can produce either a tight wave 24, a medium wave 25 or a soft loose wave 26 formed in the hair 27 as shown in these three figures. The difference in the wave is a accomplished by moving the three comb members either closer or further apart from each other. A compression coil spring 28 is located around each screw 15 and is positioned between each of the plates so that by turning the wing nut, the spaces between the comb members is controlled. Thus the different waves are produced.

In operation, a person runs the comb through his hair and then pushes with the thumb against the center comb member so to displace the center portions of the hairs laterally respective to the other combs thus resulting in the wave. When used on human hair, the hair is dampened with water or with a setting lotion after which the comb is run through the hair and operated as stated and then using a hair dryer to set the wave in place. On synthetic hair, the comb is set in place on the hairpiece, the desired wave is made and then steam is used to set the wave in place.

Figures 7, 8:
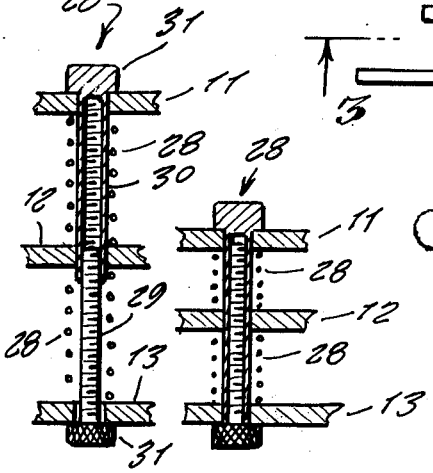
FIGS. 7, 8 and 9 shows a modified design of the structure for use in substitution of two bolts and wing nuts shown in FIGS. 1 through 6, so to give the device a more attractive appearance for enclosing all threaded ends of the screws.
Figure 3:
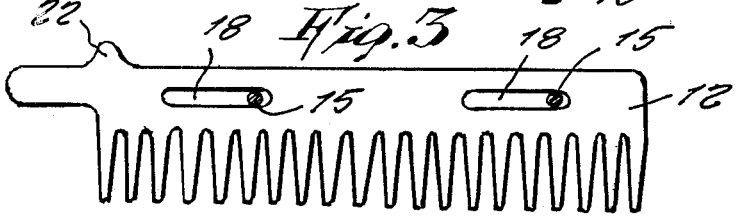
FIG. 3 is a cross-sectional view taken on line 3—3 of FIG. 2.
Figure 9:
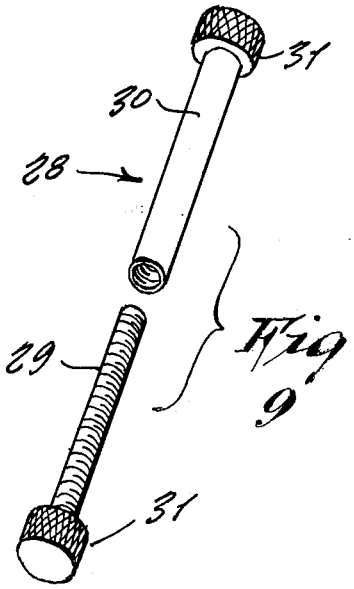

In FIGS. 7, 8 and 9, a modified structure is shown for substitution of the two bolts or screws 15 above described. The structure in FIGS. 7, 8 and 9 comprises Shicago screw post 28 consisting of screws 29 that screws into internally threaded screw member 30; the screw member and the screw each having an enlarged knurlled head 31 so that either one thereof can be turned in order that the screw post can be lengthened or shortened, as shown in FIGS. 7 and 8. The compression coil springs 28 are employed around the same in a similar manner as above described.

Figure 10:
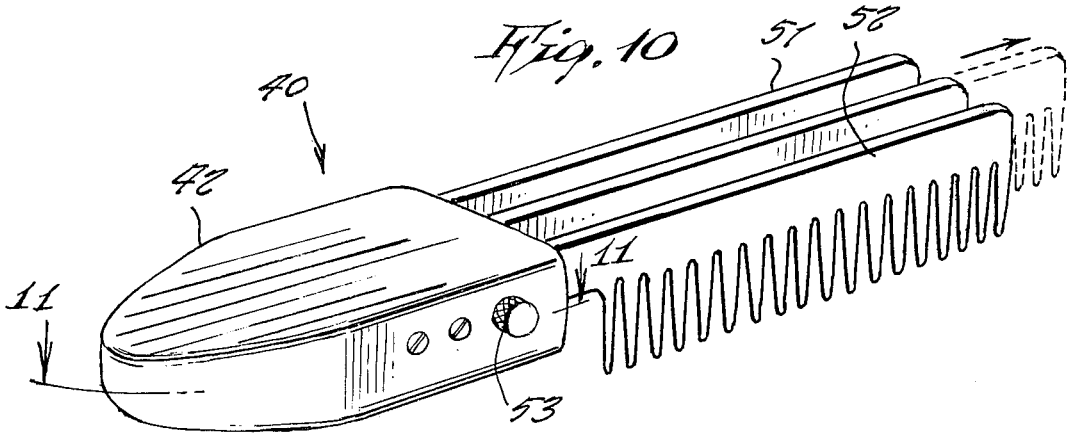
FIG. 10 is a perspective view of a modified design of the invention.
Figure 11:
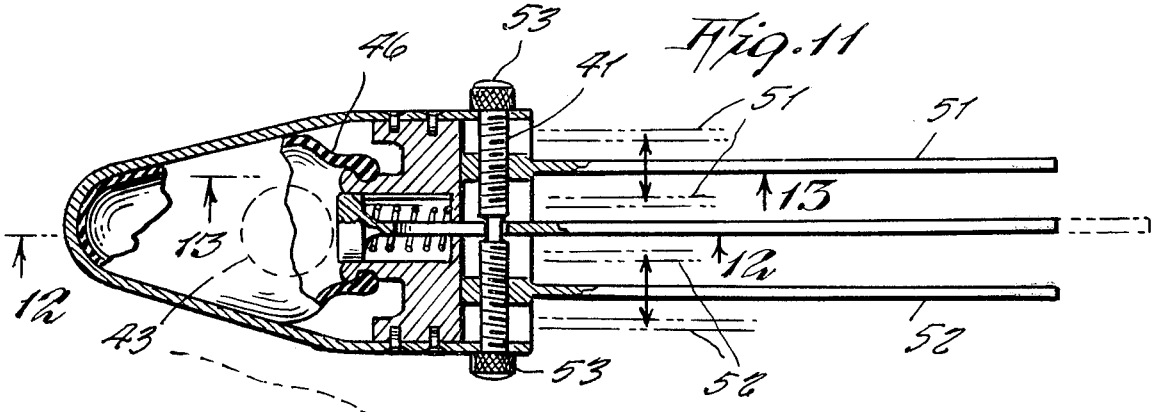
FIG. 11 is a cross-sectional view taken on line 11—11 of FIG. 10.
Figure 12:
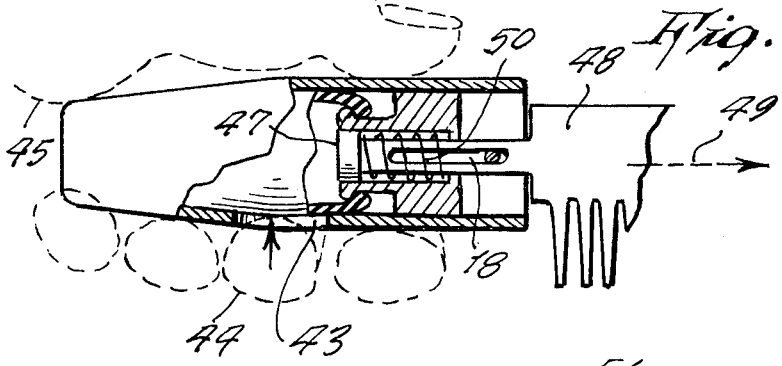
FIG. 12 is a cross-sectional view taken on line 12—12 of FIG. 11.
Figure 13:
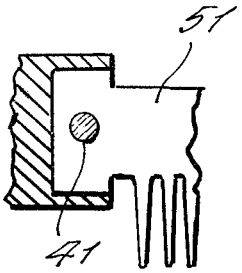
FIG. 13 is a cross-sectional view taken on line 13—13 of FIG. 12.

Referring now to FIGS. 10 through 11, there is shown a modified design of tri-comb waver 40 which is more streamlined in appearance and easier to use, the device employing a singular turn buckle 41 so as to move the side comb members closer together or further apart, thus eliminating the screws, wing nuts and the compression coiled springs. A handle 42 is referably molded of a hard plastic and forms a knob that is easy to hold in the hand, the handle 42 having an opening 43 upon its underside for a middle finger 44 of a person's hand 45 that is holding the handle, to depress a flexible rubber bulb 46 located within the interior of the handle. When the bulb is depressed, air pressure within the interior of the bulb pushes a piston 47 formed upon the end of center comb member 48, thus causing the center comb member to slide outwardly as shown by dotted lines in FIG. 10 and by the arrow 49 in FIG. 12. A compression coil spring 50 returns the center comb member back into alignment with the side comb members 51 and 52 thereafter.

Thus the device is more pleasing in appearance and the turn buckle 41 can be turned from either end where it has an enlarged knurrled head 53. This device is easy to assemble consisting of only 8 parts besides 4 mounting screws.

While various changes may be made in the detail construction, it is understood that such changes will be within the spirit and scope of the present invention as is defined by the appended claims.

What I now claim is:

1. An improved comb waver of the type containing a plurality of spaced apart combs wherein the improvement comprises:

means for adjusting the space between the combs, and means for moving at least one of said combs longitudinally without thereby adjusting the space between the combs, whereby waves of varying tightness can be created through coordinated adjustment of the spacing between combs and longitudinal movement of at least one comb.

2. The invention of claim 1 wherein the means for adjusting the space between combs is comprised of a turnbuckle.

3. The invention of claim 1 wherein the waver includes a handle means and wherein the means for longitudinally adjusting at least one of said combs is connected to the handle, whereby the waver may be held and operated with only one hand.

* * * * *